United States Patent [19]

Sampson et al.

[11] Patent Number: 4,926,594

[45] Date of Patent: May 22, 1990

[54] SKYLIGHT CONSTRUCTION

[75] Inventors: Robert Sampson, Sanford; Sean Flanigan, Wells, both of Me.

[73] Assignee: Wasco Products, Inc., Sanford, Me.

[21] Appl. No.: 283,797

[22] Filed: Dec. 13, 1988

[51] Int. Cl.[5] ..... E04B 7/18

[52] U.S. Cl. ..... 52/200; 52/403; 52/397; 52/822

[58] Field of Search ..... 52/200, 72, 403, 397, 52/788, 790, 822, 718; 49/485, 495, DIG. 1

[56] References Cited

U.S. PATENT DOCUMENTS

| | | | |
|---|---|---|---|
| 4,073,097 | 2/1978 | Jentoft et al. | 52/200 |
| 4,439,962 | 4/1984 | Jentoft et al. | 52/200 |
| 4,449,340 | 5/1984 | Jentoft et al. | 49/DIG. 2 |
| 4,466,221 | 8/1984 | Couture | 52/200 |
| 4,750,302 | 6/1988 | Bechtold | 52/788 |

*Primary Examiner*—David A. Scherbel
*Assistant Examiner*—Caroline D. Dennison
*Attorney, Agent, or Firm*—Wolf, Greenfield & Sacks

[57] ABSTRACT

A skylight that may have a domed-type or flat-type glazing and which is adapted to fit within the opening of a roof or the like. The skylight includes a peripheral curb frame that may include a base frame and an operating leaf frame. A retainer is used for securing the skylight cover over the curb frame. The curb frame is preferably constructed of a rigid plastic material having high temperature resistant properties. A glazing cushioning member is disposed between the retainer and the curb frame for providing positioning and cushioning regarding the edge of the glazing. The glazing cushioning member also receives a securing bolt and is dimensioned to control the tightening of the retainer against the glazing.

34 Claims, 3 Drawing Sheets

34
36
28
22
56
25
17
14
52
50
51
18
44
16
20
60
14
2
2
118
56
22
40
11A
34
25
11
10
28
36

SKYLIGHT CONSTRUCTION

BACKGROUND OF THE INVENTION

1. Field of the Invention

The present invention relates in general to an improved skylight construction and is concerned, more particularly, with an improved skylight construction that is made of a co-extruded plastic material, such as co-extruded PVC, that adapts itself readily to simplified manufacture and furthermore has improved temperature resistance and weathering properties. Even more particularly, the present invention relates to improvements in the skylight construction, relating to the cushioning of the glazing.

2. Background Discussion

U.S. Pat. No. 4,449,340, granted May 22, 1984, describes a skylight construction that is fabricated using a plastic material that is preferably a rigid PVC material and having co-extruded therewith certain gaskets for providing certain sealing functions associated with the skylight construction. A retainer is used for securing the skylight cover over the curb frame of the skylight. The skylight cover may be in the form of glazing plates or plastic domes or other forms of covering material. Securing bolts are employed, coupled through the retainer into the curb frame, and function to hold the glazing against the top of the curb frame. Sometimes, particularly in the transportation of the skylight, if the securing bolts are not sufficiently tight, the glazing may shift and come into contact with the securing bolts, thus causing damage to the glazing.

Accordingly, it is an object of the present invention to provide an improvement in skylight constructions in which cushioning is provided, essentially between the securing fastener associated with the retainer and the glazing or edge of the dome construction.

Another object of the present invention is to provide a new and improved skylight construction, particularly as it pertains to the use of a glazing cushioning member that provides a somewhat resilient surface for contact with the edge of the glazing and disposed intermediate the glazing and securing fastener or bolt.

A further object of the present invention is to provide a skylight construction as described in the foregoing objects, and in which the glazing cushioning member is constructed to receive the securing fastener therethrough for positioning thereof.

Still another object of the present invention is to provide a improved skylight construction in which the glazing cushioning member is constructed for snap-fit engagement with the retainer.

Another object of the present invention is to provide an improved skylight construction, as set forth in the preceding objects, and wherein the glazing cushioning member furthermore functions to control the amount of tightening of the retainer against the glazing, so that the glazing is properly retained and held in place but not over-tightened.

SUMMARY OF THE INVENTION

To accomplish the foregoing and other objects, features and advantages of the present invention, there is provided a skylight construction that is adapted to be fitted into an opening in a building such as either a commercial building or a residential building. The skylight construction comprises a curb frame that extends about the opening and includes means securing the frame about the opening. The skylight construction also includes translucent or transparent means coverinq the opening and extending at its edges to overlie the curb frame. The covering means may comprise one or more glazing plates or the covering means may also be in the form of one or more plastic domes. A retainer extends about the periphery of the skylight for holding the glazing on the curb frame. In the particular embodiment described herein, the curb frame may comprise a base frame and an overlying operating leaf frame. The curb frame is constructed of a rigid plastic material preferably having high temperature resistant properties. Gasket means are associated with the curb frame, such as for providing gasketing against the glazing.

In accordance with the present invention, associated with the skylight construction is a glazing cushioning member, that preferably snap-fits with the to leg of the retainer and has a passaqe in aliqnment with the hole through which the securing fastener for the retainer passes. The retainer has associated therewith a plurality of fasteners usually in the form of securing bolts and likewise also preferably has associated therewith a plurality of glazing cushioning members disposed about the periphery of the glazing. The glazing cushioning member includes a body adapted to be disposed between the top leg of the retainer and the top of the curb frame, and a somewhat resilient cushioning piece held by the body and disposed in facing relationship to the edge of the glazing. The height of the body of the glazing cushioning member is constructed so that when the securing bolt is tightened down, the body controls the spacing between the retainer and the curb frame so as to provide the proper pressure by the retainer on the glazing.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
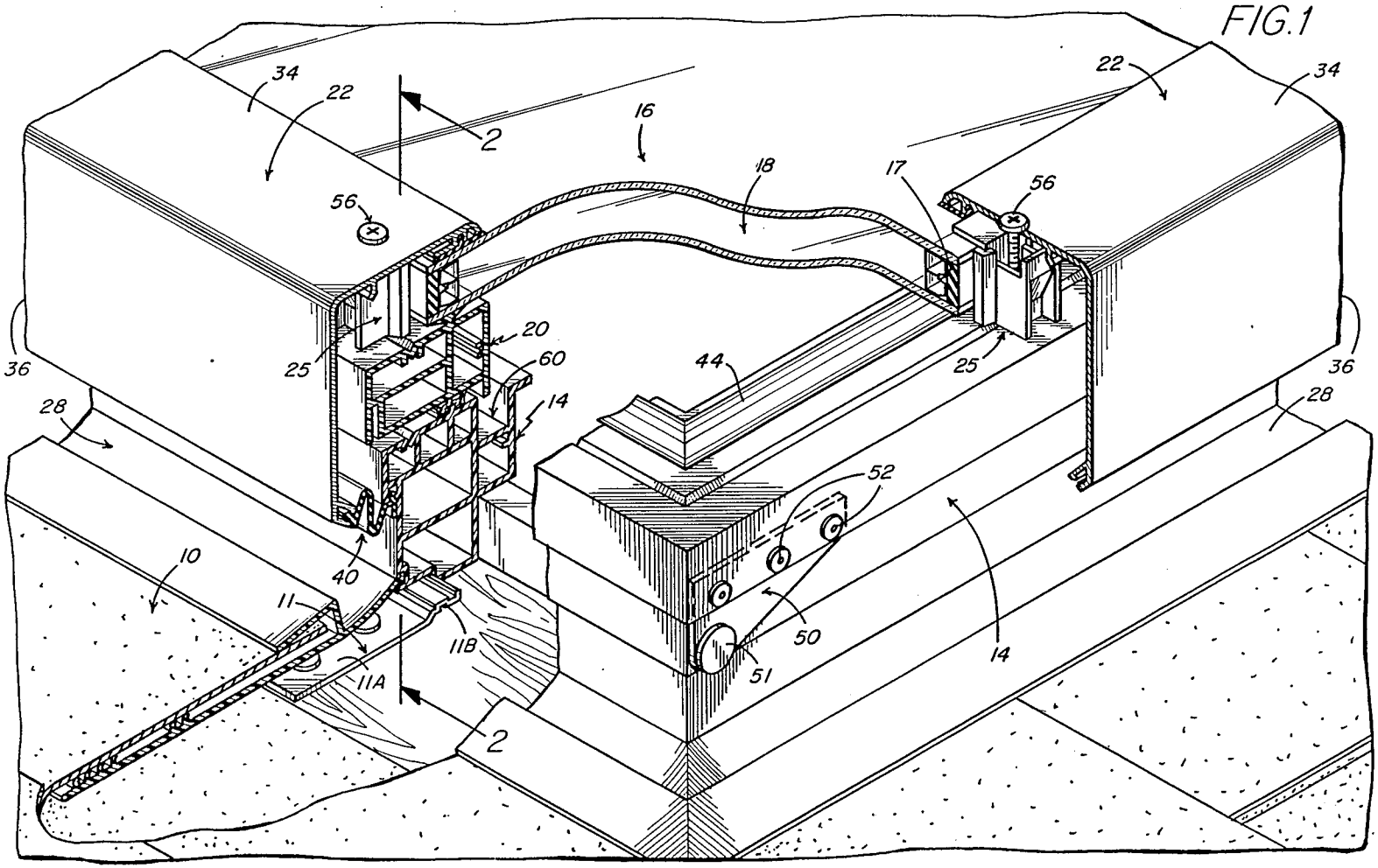
FIG. 1 is a perspective view, partially cut away, and illustrating a skylight construction in accordance with the present invention.
Figure 2:
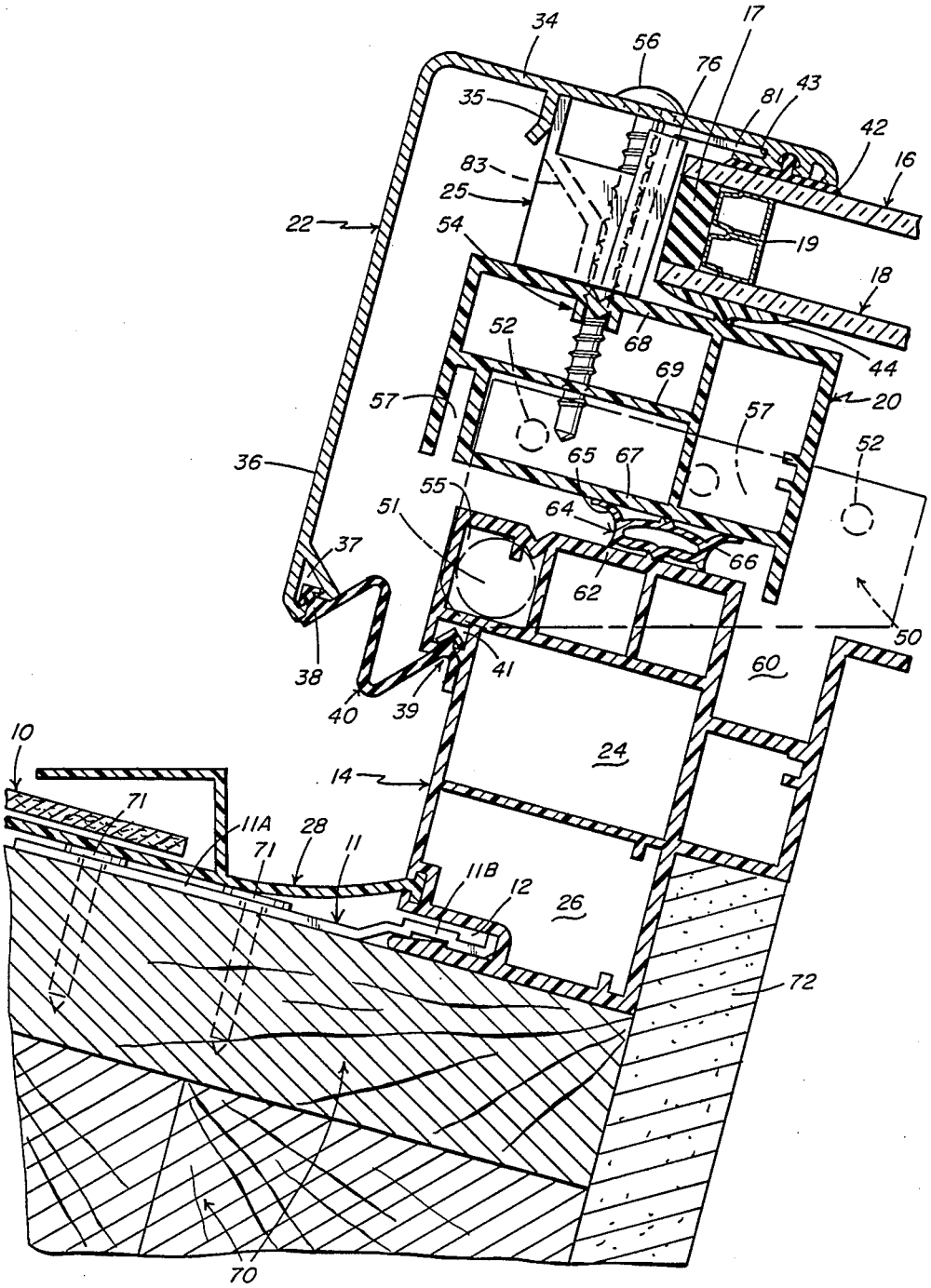
FIG. 2 is a cross sectional view taken along line 2—2 of FIG. 1 and showing further cross-sectional details of the skyliqht construction.

Reference is now made to a skylight construction as illustrated in the cut-away perspective view of FIG. 1 and the cross-sectional view of FIG. 2. In the embodiment illutrated herein in FIGS. 1 and 2, the skylight is of a flat construction, having flat glazing panels. However, in alternate constructions, a domed type of skylight may also be employed. The skylight is adapted to span an opening which is generally of square or rectangular shape and the opening may be defined by upright walls or by headers within the roof construction.

The skylight described herein is characterized by improved energy performance; thermal, air and weather tightness; simplicity of installation; good weathering properties; and enhanced durability.

The skylight construction shown herein includes a pair of glazing panels 16 and 18, a base frame 14, an operating leaf frame 20, and a retainer 22. The two frames 14 and 20 are constructed of a rigid PVC material and these frames are individually co extruded. The retainer 22 is preferably constructed of a lightweight metal material such as aluminum.

Each of the frames 14 and 20 is constructed by a co-extrusion process in which a flexible gasket such as gasket 44 is co-extruded with a rigid frame section. At the corner mitres, both the rigid and the flexible part of the frames are joined by a technique such as a heat platen sealing technique. This technique commonly joins the rigid frame sections at the corner mitres while at the same time joining the gaskets for providing a continuous seal about the entire skylight curb frame construction.

The base frame 14 may also be referred to as a fixed leaf, while the support frame 20 may also be referred to as the overlying operating leaf. The base frame 14 has internal compartments 24 and 26 and has associated therewith a peripheral sealing flange 28. As indicated, for example, in FIG. 2, the flange 28 interlocks with the base frame 14 and receives a piece of roofing such as the roofing shingle 10 illustrated in FIG. 2. Also refer to FIG 1 for a clear showing of the manner in which the shingles 10 cooperatively interengage with the sealing flange 28. For further details on the construction and associated function of the sealing flange 28, refer to the assignee's U.S. Pat. No. 4,702,049, granted October 27, 1987.

To secure the skylight, and in particular the base frame 14 thereof, in place on the roof, there are provided a plurality of securing clips 11, each having one end **11*a* for securing the clip to the roof construction and another end 11*b* received by the base frame 14 at the recess 12, as illustrated in FIG. 2. A series of these securing clips 11 may be disposed about all sides of the base frame 14. As illustrated in FIG. 2, the securing clip 11 at its end 11s is substantially flat and preferably has two holes for receiving roofing nails. The opposite end 11b of the securing clip 11 has a stepped construction to enable the securing clip to interlock in the recess 12 in the base frame 14**.

The skylight glazing plates 16 and 18 are supported over the support frame 20 by means of the retainer 22. The plates 16 and 18 are supported by a glazing frame 19. On the outer periphery of the frame 19 between the plates 16 and 18 there is a gasket 17. The gasket 17 may be of a premolded butyl material. As illustrated in FIG. 2, the frame 19 may be comprised of separate metal spacers with an outer seal comprising a chemically curable two-part polysulfide The lower glazing plate 18 rests upon a cup-shaped sealing gasket 44 which is co-extruded with the support frame 20. In FIG. 2, the gasket 44 is shown in its compressed position. The operating leaf or support frame 20 also includes means defining a channel 54 for receiving a securing bolt 56. The channel 54 is preferably threaded to receive the bolt 56. There are actually a plurality of these securing bolts or screws that are employed for securing the retainer 22 over the glazing plates 16 and 18. Two of the securing bolts 56 are shown in the perspective view of FIG. 1, each having associated therewith a cushion member 25. The securing bolt 56 actually passes through the glazing securing member 25, forming a cushioning for the edges of the glazing plates to prevent damage thereto, as well as to facilitate positioning thereof.

The retainer 22 has a top leg 34 and a side leg 36. The retainer 22 i generally of L-shaped construction At the bottom end of leg 36 there is provided a pair of walls defining an interlocking channel 37 for receiving one end 38 of the header gasket 40 The other end 39 of the header gasket 40 is received within an interlocking channel 41 formed in the base frame 14. In FIG. 2 the header gasket 40 is shown in the closed position of the skyliqht with the header gasket thus in its more elongated form.

The top leg 34 of the retainer 22 is also adapted to receive a gasket, illustrated in FIG. 2 as the relatively flat gasket 42 that is interlocked with the very free end of the leg 34. The gasket 42 may be constructed of a premolded butyl material and is adapted to engage with and securely hold the top of the glazing plates, contacting the plate 16 as illustrated in FIG. 2. The top leg 34 also has a depending wall 35 for engagement by the glazing cushion member 25. The leg 34 also includes a slot 43 for receiving a leg of the class cushion member 25.

As indicated previously, the particular skyliqht construction depicted herein is in the form of a two part curb frame with a base frame added overlying the operating frame. For the purpose of opening the operating frame, there is provided a hinge 50, one on either side of the skylight. The cut-away perspective view of FIG. 1 shows the hinge 50 having associated therewith a pivot pin 51 and rivets 52. FIG. 2 also shows, in dotted outline, the hinge 50 and the placement of the pop rivets at 52. FIG. 2 also shows, in dotted outline, the pivot pin 51. The pin 51 is adapted to be retained in the channel 55 of the base frame 14. The overlying leaf frame 20 has a peripherally disposed channel 57 and along the sides thereof, the hinge 50 is pop riveted to the frame 20 while the hinge 50 is maintained in this channel 57.

Regarding the base frame 14, as indicated previously, it includes compartments 24 and 26, recess 12 for receiving the securing clip 11 as well as channels for receiving the pivot pin 51 and the header gasket 40. The base frame 14 also is provided with a condensation gutter 60 and furthermore supports at its top wall 62 the gasket 64. The gasket 64 is constructed to provide multiple sealing points. The gasket 64 is generally of cylindrical construction but is provided with separately disposed ears such as the ears 65 and 66 illustrated in FIG. 2. FIG. 2 clearly illustrates the multiple sealing points of the gasket 64. It is also noted that multiple sealing points are provided not only at the wall 62 but also at the wall 67 of the overlying leaf frame 20 In FIG. 2 the gasket 64 is shown in partially compressed position and providing an effective watertight seal between the separate curb frame sections.

Reference has been made hereinbefore to the bolt 56 as it relates to securing the retainer to the curb frame As noted in FIG. 2, the bolt 56 preferable, passes not only through the threaded channel 54 in wall 68 of the frame 20, but also through the wall 69. In other words, the securing bolt 56 actually penetrates two walls of the frame 20. This adds further stability to the overall skyliqht construction, particularly as it relates to the retaining of the glazings.

FIG. 2 shows a part of the building construction, including building members 70, which may be of wood construction such as typical 2 x 4s or 2 x 6s. FIG. 2 shows the roofing nails 71 used through the securing clip 11 and driven into the members 70. There is also illustrated in FIG. 2 a qypsum board 72 associated with the base frame 14. This is a typical building construction that can be used and that is associated with the skyliqht.

Figure 3:
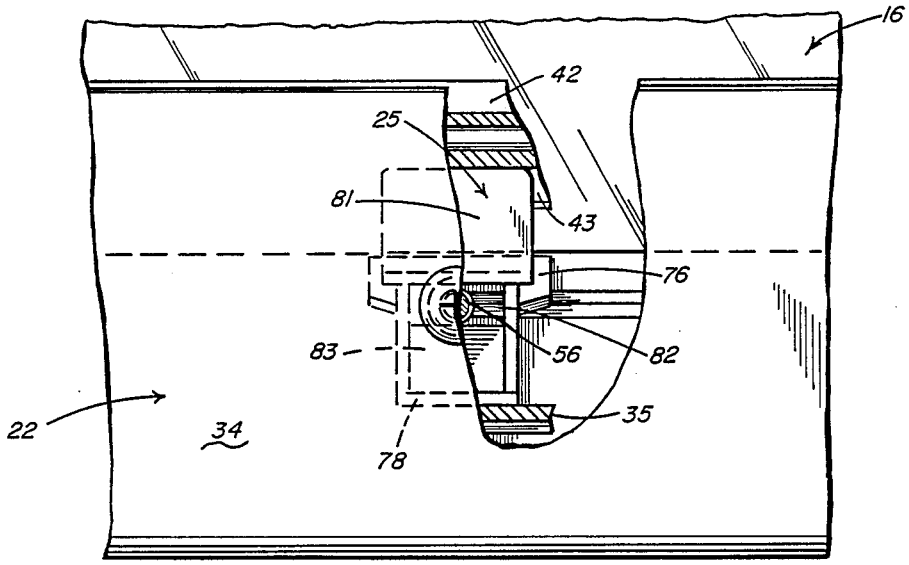
FIG. 3 is a fragmentary plan view of the skyliqht construction at a securing bolt and partially cut away to show further details of the glazing cushioning member.
Figure 4:
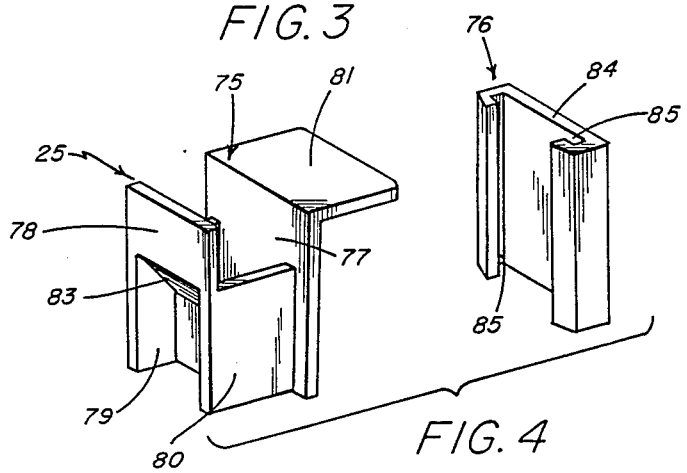
FIG. 4 is a perspective view showing the components of the glazing cushioning member.
Figure 5:
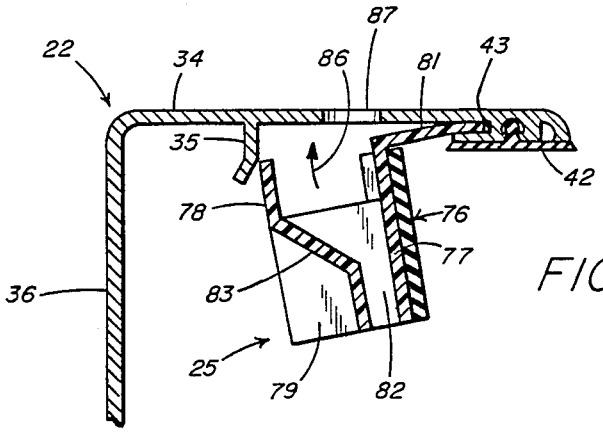
FIG. 5 is a cross-sectional view showing the manner in which the glazing cushioning member is snap fitted into the retainer.

Reference is now made to FIGS. 3–5 for further the glazing cushioning member 25. In this regard, reference is also made to the cross-sectional view of FIG. 2 that shows the glazing cushioning member 25 as snap-fitted into place in the retainer 22. FIG. 2 clearly illustrates the positioning of the member 25 in close proximity to the glazing.

The glazing cushioning member 25 is comprised of a rigid plastic body 75 and a somewhat resilient cushioning piece 76. The body 75 has front and rear walls 77 and 78, side walls 79 and 80, and leg 81. The leg 81 is disposed at right angles to the wall 77. These various walls define a hollow passage 82 defined in part by the tapered wall 83. The tapered wall 83 assists in guidance of the securing bolt 56 into and through the passage 82. In this regard, the securing bolt 56 is shown in place, having passed through the passage 82 in the body 75. The cushioning piece 76 is comprised of a cushioning wall 84 and turned ends defining opposed channels 85. The cushioning piece 76 is adapted to slide onto the wall 77 with the opposite sides of the wall 77 engaging in the opposed channels 85. In this regard, FIG. 5 shows the cushioning piece 76 in place on the body 75.

FIG. 5 illustrates the action of the glazing cushioning member 25 snap fitted by movement in the direction of the arrow 86. The wall 78 engages with the wall 35, which forms part of the retainer 22. Initially, the leg 81 of the body 75 is disposed in the slot 43 in the retainer FIG. 5 illustrates the leg in place and the body now being snapped upwardly to engage with the retainer. The passage 82 is adapted to be disposed in alignment with a bolt hole 87 provided in the retainer top leg 34, for receipt of a securing bolt. Again, FIG. 2 clearly illustrates the placement of the securing bolt 56 as it relates to the body 75 and the passage 82 thereof FIG. 2 also illustrates one other function of the member 25. The height of the member 25 is made so that then the securing bolt 56 is tightened down the proper amount of pressure is applied by the retainer against the glazing. This prevents overtightening of the securing bolt and makes the installation of the glazing on the curb frame more foolproof.

The body 75 of the glazing cushioning member 25 is preferably constructed of a quite rigid PVC material. The cushioning piece 76, on the other hand, is made of a material that is at least partially resilient and that will provide some cushioning should the glazing panel shift and contact the piece 76. Without this cushioning effect, the glazing could easily contact the securing bolt and could cause damage to the glazing. The cushioning piece 76 may be secured to the body by a close tolerance fit or some small amount cf adhesive may be applied therebetween.

In the preferred embodiment disclosed herein, it is noted that the securing fastener passes through the glazing cushioning member 25. In an alternate embodiment the securing fastener may be disposed adjacent to the glazing cushioning member in which case the fastener would not pass then through the opening therein. In this instance, the fastener which may be a securing bolt can be disposed say an inch or so away from the glazing cushioning member and is adapted to extend through the top wall of the retainer and into the curb frame.

In summary, the glazing cushioning member of the present invention provides a cushioning for the glazing It also provides a stable support between the retainer and the curb frame and prevents twisting and turning of the retainer as it is being secured in place. The glazing cushioning member also provides, in the preferred embodiment, a guide for the securing fastener to provide positive and precise locating thereof. The glazing cushioning member also assists in providing proper weather tightness. The glazing cushioning member is constructed so as to control the proper tightening of the securing fastener so as to make the installation of the glazing on the curb frame more foolproof

Having now described a limited number of embodiments of the present invention, it should now become apparent to those skilled in the art that numerous other embodiments and modifications are contemplated as falling within the scope of the present invention, as defined by the appended claims.

What is claimed is:

1. A skylight construction for an opening in a building or the like comprising: a curb frame extending about the opening including means for securing thereof about the opening, translucent or transparent means for covering the opening and extending at edges to overlie the curb frame, means for retaining the covering means on the curb frame, said means for retaining including a retainer and associated securing fastener, and a cushioning member disposed between said retainer and curb frame and including a resilient cushioning piece supported laterally adjacent the peripheral edge of said covering means, said cushioning member having passage means therethrough for receiving and guiding said securing fastener.

2. A skylight construction as set forth in claim 1 wherein said curb frame comprises an operating leaf frame and a base frame, said operating leaf frame overlying said base frame and said glazing cushioning member being disposed between said retainer and said operating leaf frame.

3. A skylight construction as set forth in claim 2 wherein said operating leaf frame has a gasket extending therefrom and disposed between the operating leaf frame and covering means.

4. A skylight construction as set forth in claim 2 in cluding hinge means between the base frame and operating leaf frame.

5. A skylight construction as set forth in claim 1 wherein said covering means includes at least one plate means.

6. A skylight construction as set forth in claim 5 wherein said covering means includes a pair of glazing plates.

7. A skylight construction as set forth in claim 1 wherein said cushioning member snap-fits with said means for retaining.

8. A skylight construction as set forth in claim 7 wherein said cushioning member includes a body of a rigid plastic material and said cushioning piece is supported on said body and is of a more resilient plastic material than said body.

9. A skylight construction as set forth in claim 8 wherein said body is defined by a plurality of walls forming said passage means.

10. A skylight construction as set forth in claim 9 wherein said body includes a leg and said retainer has a channel for receiving said leg.

11. A skylight construction as set forth in claim 10 wherein said leg is disposed substantially orthoqonal to one of the body walls.

12. A skylight construction as set forth in claim 11 wherein one of said body walls is tapered to quide the securing fastener.

13. A skylight construction as set forth in claim 12 wherein said retainer has a downwardly depending leg spacedly disposed from the retainer channel and adapted to engage in a snap-fit action with one of the walls of said body.

14. A skylight construction as set forth in claim 13 wherein said body has top and bottom ends engaging the respective retainer and top wall of the curb frame for limiting and defining the spacing between the curb frame and the retainer.

15. A skylight construction for an opening in a building or the like comprising: a curb frame extending about the opening and including means for securing the curb frame about the opening, translucent or transparent means covering the opening and extending at edges to overlie the curb frame, a retainer for holding the covering means on the curb frame, and a cushioning member disposed between the retainer and curb frame and including a cushioning piece supported adjacent said covering means, said cushioning member adapted to snap-fit with said retainer to maintain the cushioning member in position on the retainer for support between the retainer and a top wall of the curb frame.

16. A skylight construction as set forth in claim 15 wherein said retainer also has associated therewith at least one securing fastener and said cushioning member has passage means therethrough for receiving and guiding said securing fastener.

17. A skylight construction as set forth in claim 15 wherein said cushioning member comprises a body for supporting said cushioning piece 18. A skylight construction as set forth in claim 15 wherein said retainer has a recess and said cushioning member has a leg, said leg and recess interengaging to provide interlocking between the cushioning member and the retainer.

19. A skylight construction as set forth in claim 15 wherein said cushioning member includes a body of a rigid plastic material, said cushioning piece being of a more resilient plastic material than said body and said body having a plurality of walls defining a passage for receiving a securing fastener.

20. A skylight construction as set forth in claim 19 wherein one of the body walls is tapered for guiding said securing bolt.

21. A skylight construction as set forth in claim 15 wherein said retainer has a depending wall for providing snap-fit action between said cushioning member and said retainer.

22. A skylight construction for an opening in a building or the like comprising: a curb frame extending about the opening and including means for securing the curb frame about the opening, translucent or transparent means for covering the opening and extending at edges to overlie the curb frame, a retainer for holding the covering means on the curb frame, and a cushioning member disposed between the retainer and curb frame, and including a relatively rigid body and a relatively resilient cushioning piece supported laterally adjacent the peripheral edge of said covering means and for cushioning said covering means, means for securing said cushioning member from an inside surface of said retainer, said cushioning piece being disposed on said body in facing relationship to said covering means and intermediate said! body and covering means, and a securing fastener intercoupling said retainer and curb frame, sandwiching said cushioning member therebetween.

23. A skylight construction as set forth in claim 22 wherein said cushioning member has passage means therethrough for receiving and guiding said securing fastener.

24. A skylight construction as set forth in claim 23 wherein said cushioning member snap-fits with said retainer.

25. A skylight construction as set forth in claim 22 wherein said retainer has a recess and said cushioning body has a leg, said leg and recess interengaging to provide interlocking between the cushioning member and the retainer, said cushioning member body being of a more resilient plastic material than said body.

26. A skylight construction for an opening in a building or the like comprising: a curb frame extending about the opening including means for securing thereof about the opening, translucent or transparent means covering the opening and extending at edges to overlie the curb frame, means for retaining the covering means on the curb frame, said means for retaining including a retainer and associated securing fastener, and a cushioning member disposed between said retainer and curb frame and including a cushioning piece supported adjacent said covering means, said cushioning member including a body for supporting said cushioning piece, said body being of a rigid plastic material and said cushioning piece being of a more resilient plastic material, and said body including a leg and said retainer having a channel for receiving said leg.

27. A skylight construction as set forth in claim 26 wherein said leg is disposed substantially orthogonal to one of the body walls.

28. A skylight construction as set forth in claim 27 wherein said cushioning members has passage means therethrough for receiving and guiding said securing fastener, and said body is defined by a plurality of walls forming said passage means, one of said body walls being tapered to guide the securing fastener.

29. A skylight construction as set forth in claim 28 wherein said retainer has a downwardly depending leg spacedly disposed from the retainer channel and adapted to engage in a snap-fit action with one of the walls of said body.

30. A skylight construction as set forth in claim 29 wherein said body has top an bottom ends engaging the respective retainer and top wall of the curb frame for limiting and defining the spacing between the curb frame and the retainer.

31. A skylight construction for an opening in a building or the like comprising: a curb frame extending about the opening and including means for securing the curb frame about the opening, translucent or transparent means covering the opening and extending at edges to overlie the curb frame, a retainer for holding the covering means on the curb frame, and a cushioning member disposed between the retainer and curt, frame and including means supported adjacent said covering means for cushioning thereof, and a securing fastener intercoupling said retainer and curb frame, sandwiching said cushioning member therebetween, said cushioning member having passage means therethrough for receiving and guiding said securing fastener, said cushioning member comprising a body and associated cushioning piece, wherein said retainer has a recess and said cushioning body has a leg, said leg and recess interengaging to provide interlocking between the cushioning member and the retainer, said cushioning member body being of a rigid plastic material and said cushioning piece being of a more resilient plastic material than said body.

32. A skylight construction for an opening in a building or the like comprising: a curb frame extending about the opening including means for securing thereof about the opening, translucent or transparent means covering the opening and extending at edges to overlie the curb frame, means for retaining the covering means on the curb frame, said means for retaining including a retainer and associated securing fastener and a cushioning member disposed between said retainer and curb frame and including a cushioning piece supported adjacent said covering means, wherein said cushioning member also includes a body for supporting said cushioning piece, said body being of a rigid plastic material and said cushioning piece being of a more resilient plastic material in comparison to the material of the body, and means for securing said cushioning member from said retainer so as to dispose said cushioning member laterally adjacent and in facing relationship to the peripheral edge of said covering means.

33. A skylight construction as set forth in claim 32 wherein said means for securing includes means for snap-fitting the cushioning member with the retainer.

34. A skylight construction as set forth in claim 32 wherein the means for securing the cushioning member provides support from an inside surface of said retainer, said cushioning piece being disposed on said body in facing relationship to said covering means and intermediate said body and covering means.

* * * * *